US007231736B2

(12) United States Patent
Labin

(10) Patent No.: US 7,231,736 B2
(45) Date of Patent: Jun. 19, 2007

(54) CONCEALED FOLDOUT SHELF AND/OR BOX

(76) Inventor: Rachel Labin, 38 Kehilot Yaakov, Bnei Brak 51642 (IL)

( * ) Notice: Subject to any disclaimer, the term of this patent is extended or adjusted under 35 U.S.C. 154(b) by 63 days.

(21) Appl. No.: 11/201,241

(22) Filed: Aug. 11, 2005

(65) Prior Publication Data

US 2006/0143965 A1 Jul. 6, 2006

(51) Int. Cl.
*A47G 1/06* (2006.01)
*A47G 1/08* (2006.01)

(52) U.S. Cl. ..... 40/725; 40/743; 40/779; 40/780; 40/786

(58) Field of Classification Search ..... 206/578, 206/232; 40/124.08, 124.14, 124.16, 725, 40/780, 786, 739, 740, 741, 743, 779, 781, 40/539
See application file for complete search history.

(56) References Cited

U.S. PATENT DOCUMENTS 930,108 A * 8/1909 Walcutt ..... 446/148
4,854,060 A * 8/1989 Corbo et al. ..... 40/720

* cited by examiner

*Primary Examiner*—Robert J. Sandy
*Assistant Examiner*—Syed A. Islam
(74) *Attorney, Agent, or Firm*—Dekel Patent Ltd; David Klein

(57) ABSTRACT

A foldable shelf including a picture in a picture frame, the picture including at least one foldable shelf member, which in a first configuration is generally flat and removably fixed in the picture frame, and in a second configuration is folded out of the picture frame and removably fixed in a position adapted for supporting an object thereupon.

6 Claims, 1 Drawing Sheet

CONCEALED FOLDOUT SHELF AND/OR BOX

FIELD OF THE INVENTION

The present invention relates generally to shelves for supporting objects, and more specifically to a foldable shelf and/or box concealed in a picture frame, which may be folded out to support objects thereon, such as a candelabrum.

BACKGROUND OF THE INVENTION

Many different kinds of shelves are known and used for supporting objects, such as books, vases, glassware, silverware, candelabra and many more. Typically such shelves are either part of a cabinet (e.g., bookshelves) whose weight is supported on the floor, or separate shelves that are supported on walls with brackets and the like.

Some objects are stored on the shelf but are not used on the shelf. For example, a vase may be stored on the shelf when not in use, and may be removed from the shelf and placed on a table for displaying flowers placed therein. Similarly, a candelabrum may be stored on the shelf when not in use, and may be removed from the shelf and placed on a table for lighting wax candles and the like.

SUMMARY OF THE INVENTION

The present invention seeks to provide a novel foldable shelf and/or box concealed in a picture frame, which may be folded out to support objects thereon, such as a candelabrum.

There is thus provided in accordance with an embodiment of the present invention a foldable shelf including a picture in a picture frame, the picture including at least one foldable shelf member, which in a first configuration is generally flat and removably fixed in the picture frame, and in a second configuration is folded out of the picture frame and removably fixed in a position adapted for supporting an object thereupon.

The at least one foldable shelf member may include a crease along which it is foldable. The at least one foldable shelf member may be foldable near a lower and/or middle portion of the picture frame. A top shelf member may be foldable outwards of the picture frame. Side shelf members may be foldable outwards of the picture frame.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Reference is now made to FIGS. 1–4, which illustrate a foldable shelf 10, constructed and operative in accordance with an embodiment of the present invention.

Foldable shelf 10 may include a picture 12 in a picture frame 14. The picture 12, which may be any kind of painting or photograph and the like, may include one or more foldable shelf members. The picture 12 is either the thickness of the shelf member or is attached to the shelf member, such as by bonding with an adhesive.

Figure 4:
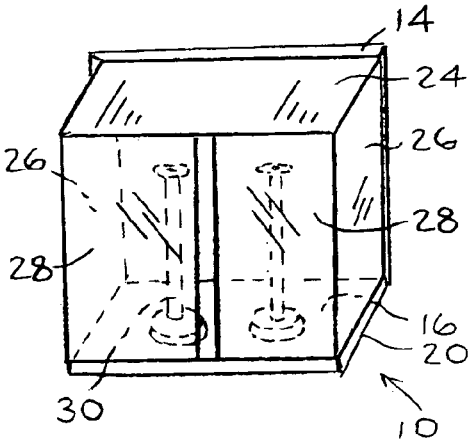
FIG. 4 is a simplified pictorial illustration of the foldable shelf of FIG. 1, wherein the shelf is in a completely folded out configuration and forms a box with the first shelf member and side and top shelf members, and an object is placed in the shelf/box.

In the illustrated embodiment, the picture 12 includes a first foldable shelf member 16, which it is foldable along a crease 18 near a lower portion of picture frame 14, and a second foldable shelf member 20, which it is foldable along a crease 22 near a middle portion of picture frame 14. First and second foldable shelf members 16 and 20 eventually form the bottom shelf member of the finished shelf/box (as seen in FIG. 4). First and second foldable shelf members 16 and 20 may be attachable to each other, such as but without limitation, by means of hooks, VELCRO or any other kind of fastener.

Figure 1:
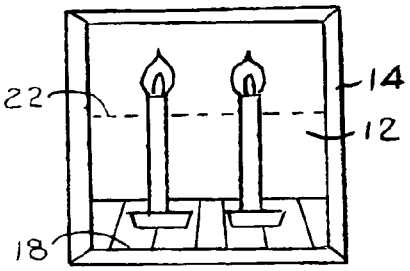
FIG. 1 is a simplified pictorial illustration of a foldable shelf, constructed and operative in accordance with an embodiment of the present invention, wherein the shelf is in a stored configuration and is part of a painting in a picture frame.
Figure 2:
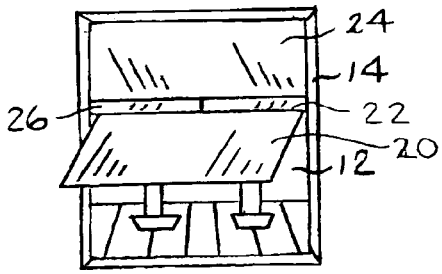
FIG. 2 is a simplified pictorial illustration of the foldable shelf of FIG. 1, wherein a first shelf member of the shelf is folded outwards and downwards.
Figure 3:
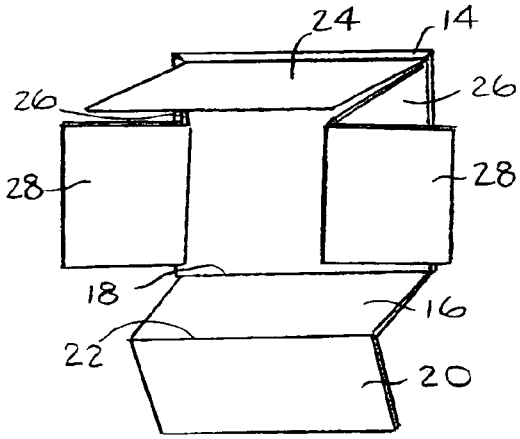
FIG. 3 is a simplified pictorial illustration of the foldable shelf of FIG. 1, wherein a second shelf member of the shelf is folded outwards and downwards, and side and top shelf members are also folded outwards.

Thus, first and second foldable shelf members 16 and 20, in a first configuration shown in FIG. 1 (where a person in the room simply sees the picture 12 in frame 14), are generally flat and removably fixed in picture frame 14, and in a second configuration (shown in FIG. 4) are folded out of picture frame 14 and are removably fixed in a position adapted for supporting an object thereupon. In the first configuration, first and second foldable shelf members 16 and 20 may be fixed in picture frame 14 by means of hooks, VELCRO, removable and reusable adhesive, or any other kind of fastener.

Foldable shelf 10 may further include a top shelf member 24 that is foldable outwards of picture frame 14. In addition, foldable shelf 10 may include side shelf members that are foldable outwards of picture frame 14. The side shelf members may each include two foldable panels 26 and 28.

As seen in FIG. 4, first and second foldable shelf members 16 and 20, top shelf member 24 and side shelf members 26 and 28 combine, when folded out of picture frame 14, to form the finished foldable shelf/box 10. An object 30, such as but not limited to, a candelabrum 30 may be supported on first foldable shelf member 16.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A foldable shelf comprising:

a picture in a picture frame, said picture comprising at least one foldable shelf member, which in a first configuration is generally flat and removably fixed in said picture frame, and in a second configuration is folded out of said picture frame and removably fixed in a position adapted for supporting an object thereupon, and top and side shelf members that are foldable outwards of said picture frame, wherein the at least one foldable shelf member and the top and side shelf members form a box when folded out of said picture frame.

2. The foldable shelf according to claim 1, wherein said at least one foldable shelf member is foldable along a crease formed in said at least one foldable shelf member.

3. The foldable shelf according to claim 1, wherein said at least one foldable shelf member is foldable near a lower portion of said picture frame.

4. The foldable shelf according to claim 1, wherein said at least one foldable shelf member is foldable near a middle portion of said picture frame.

5. The foldable shelf according to claim 1, further comprising a candelabrum supported on said at least one foldable shelf member.

6. A foldable shelf comprising:

a picture in a picture frame, said picture comprising at least one foldable shelf member, which in a first configuration is generally flat and removably fixed in said picture frame, and in a second configuration is folded out of said picture frame and removably fixed in a position adapted for supporting an object thereupon, wherein said at least one foldable shelf member is foldable along a crease formed in said at least one foldable shelf member, and wherein said at least one foldable shelf member is foldable near at least one of lower and middle portions of said picture frame; and top and side shelf members that are foldable outwards of said picture frame, wherein the at least one foldable shelf member and the top and side shelf members form a box when folded out of said picture frame.

* * * * *